US005431382A

United States Patent [19]

Boot et al.

[11] Patent Number: 5,431,382

[45] Date of Patent: Jul. 11, 1995

[54] FABRIC PANEL FEED SYSTEM

[75] Inventors: Jeffrey T. Boot, Sudbury; Matthew D. Bouche, Chelmsford, both of Mass.

[73] Assignee: Design Technology Corporation, Billerica, Mass.

[21] Appl. No.: 183,494

[22] Filed: Jan. 19, 1994

[51] Int. Cl.[6] ..... B65H 5/22

[52] U.S. Cl. ..... 271/4.02; 271/10.05; 271/19; 271/227; 271/241; 271/267; 271/194; 271/265.01; 38/7; 38/16; 38/143

[58] Field of Search ..... 271/4, 5, 10, 11, 19, 271/227, 241, 265, 267, 194, 85, 84, 93, 91; 112/DIG. 2, 306, 121.12; 38/2, 143, 7, 15, 16; 209/939

[56] References Cited

U.S. PATENT DOCUMENTS

| | | | |
|---|---|---|---|
| 3,564,738 | 2/1971 | Batzdorff et al. | 38/143 |
| 3,588,087 | 6/1971 | Rovin et al. | 271/267 |
| 4,053,967 | 10/1977 | Mair | 38/143 |
| 4,353,539 | 10/1982 | Doyen et al. | 271/10 |
| 4,435,837 | 3/1984 | Abernathy | 112/121.12 |
| 4,583,727 | 4/1986 | Fort | 271/19 |
| 4,693,460 | 9/1987 | Adamson et al. | 271/10 |
| 4,819,784 | 4/1989 | Sticht | 209/939 |
| 5,131,339 | 7/1992 | Goodridge | 271/227 |
| 5,178,080 | 1/1993 | Nomura et al. | 271/241 |
| 5,207,413 | 5/1993 | Maron | 271/267 |

FOREIGN PATENT DOCUMENTS

| | | | |
|---|---|---|---|
| 0136839 | 6/1986 | Japan | 271/91 |

*Primary Examiner*—H. Grant Skaggs
*Attorney, Agent, or Firm*—Rhodes, Coats & Bennett

[57] ABSTRACT

A fabric panel loader for automatically feeding a fabric panel from a stack of fabric pieces to a work station. The apparatus includes a fabric pickup assembly for removing the fabric panel from the stack of fabric pieces and transferring the panel to a smoothing table. The smoothing table receives the fabric panel and automatically moves the fabric panel from the stack of fabric pieces to a predetermined orientation. A panel loader removes the fabric panel from the table and transfers the panel to the work station.

19 Claims, 8 Drawing Sheets

FABRIC PANEL FEED SYSTEM

BACKGROUND OF THE INVENTION

1. Field of the Invention

The present invention relates generally to fabric handling systems and, more particularly, to a system for precisely moving a fabric panel from a stack of fabric panels to a work station.

2. Description of the Prior Art

Fabric panels for apparel are typically cut or die cut and bundled into packages for subsequent transfer to a work station where the bundles are opened and the panels are assembled into garments or partial garments. In the past this has primarily been a manual operation since fabric pieces are soft goods and are easily distorted by mechanical handling systems. However, with the advent of more sophisticated material handling systems there has been renewed interest in automating at least some sewing operations.

One operation which has resisted automation is the removal of a fabric panel from a stack of fabric pieces and presentation of the fabric panel to a work station for a sewing operation. Some attempts have been made at this operation by the use of fabric pickups in combination with edge detectors to locate at least the leading edge of the fabric piece. However, because lightweight knitted fabric pieces are easily distorted by mechanical handling, such systems have only been successful with heavy weight fabrics such as denim.

Thus, there remains a need for a new and improved fabric panel loader which is operable both to remove a fabric panel from a stack of fabric pieces and to precisely position the fabric panel for transfer to a work station.

SUMMARY OF THE INVENTION

The present invention is directed to a fabric panel loader for automatically feeding a fabric panel from a stack of fabric pieces to a work station. The apparatus includes a fabric pickup assembly for removing the fabric panel from the stack of fabric pieces and transferring the panel to a smoothing table. The smoothing table receives the fabric panel and automatically moves the fabric panel from the stack of fabric pieces to a predetermined orientation. The smoothing table includes a table for receiving the fabric panel from the stack of fabric pieces and drive means attached to the table for moving the table. A vision system connected to the drive means controls the drive means to move the table in response a control signal indicating the position of the fabric panel. A panel loader removes the fabric panel from the table and transfers the panel to the work station.

Accordingly, one aspect of the present invention is to provide an apparatus for automatically feeding a fabric panel from a stack of fabric pieces to a work station. The apparatus includes: (a) a table for receiving the fabric panel from the stack of fabric pieces, the table being operable to move the fabric panel into a predetermined orientation; and (b) a panel loader for removing the fabric panel from the table and transferring the panel to the work station.

Another aspect of the present invention is to provide an apparatus for automatically moving a fabric panel from a stack of fabric pieces to a predetermined orientation. The apparatus includes: (a) a table for receiving the fabric panel from the stack of fabric pieces; (b) drive means attached to the table for moving the table; and (c) a vision system connected to the drive means for controlling the drive means to move the table in response a control signal indicating the position of the fabric panel.

Still another aspect of the present invention is to provide an apparatus for automatically feeding a fabric panel from a stack of fabric pieces to a work station. The apparatus includes: (a) a fabric pickup assembly for removing the fabric panel from the stack of fabric pieces and transferring the panel; (b) a smoothing table for receiving the fabric panel and for automatically moving the fabric panel from the stack of fabric pieces to a predetermined orientation, the smoothing table including: (i) a table for receiving the fabric panel from the stack of fabric pieces; (ii) drive means attached to the table for moving the table; and (iii) a vision system connected to the drive means for controlling the drive means to move the table in response a control signal indicating the position of the fabric panel; and (c) a panel loader for removing the fabric panel from the table and transferring the panel to the work station.

These and other aspects of the present invention will become apparent to those skilled in the art after a reading of the following description of the preferred embodiment when considered with the drawings.

DESCRIPTION OF THE PREFERRED EMBODIMENTS

Figure 1:
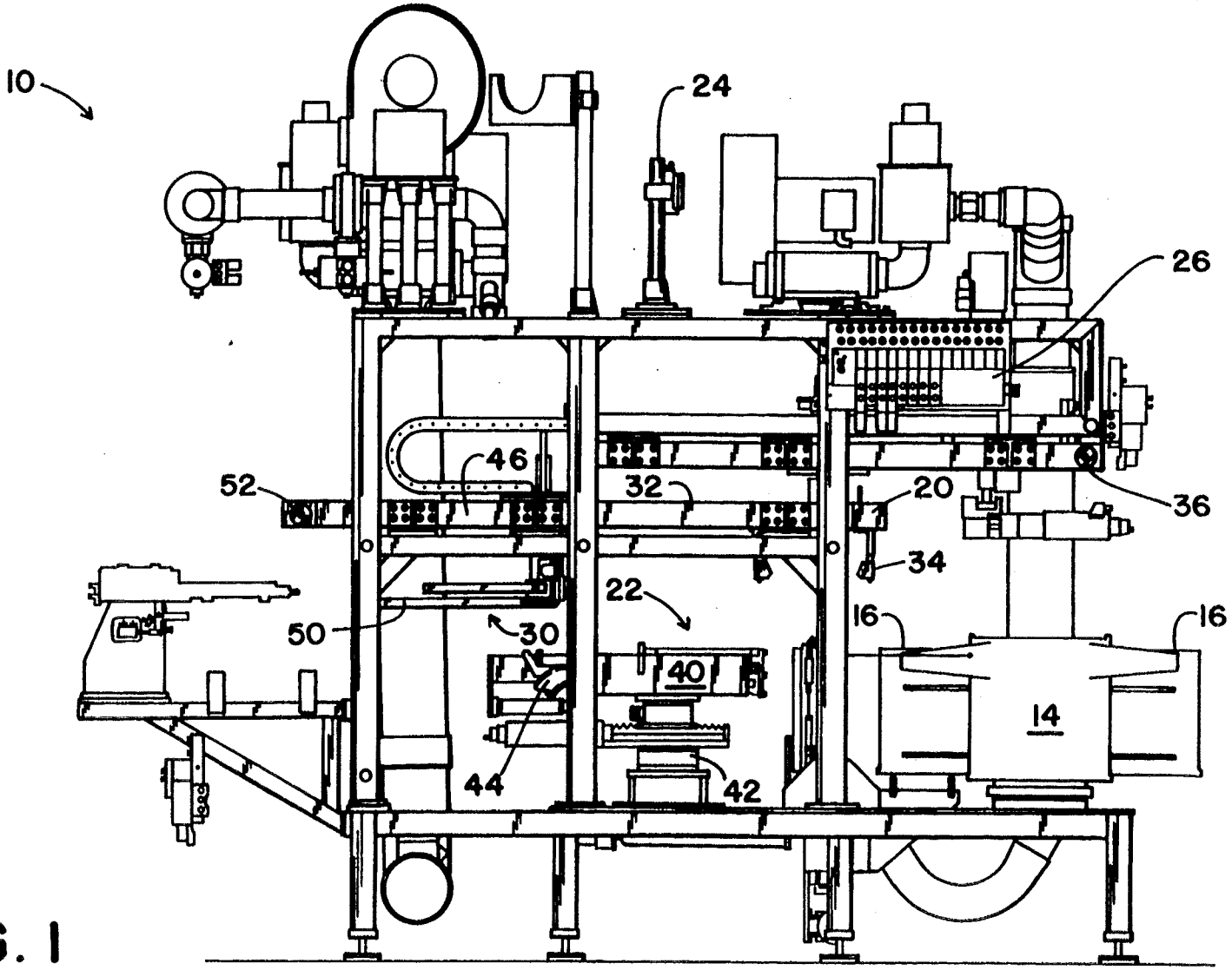
FIG. 1 is a side elevational view of a panel feeding machine constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, there is shown a panel feeding machine, generally designated 10, constructed according to the present invention.

Panel feeding machine 10 includes a supply magazine 14 for holding a stack of fabric pieces 16. An unloader assembly 20 adjacent to supply magazine 14 removes single panels of fabric pieces from stack 16 and transfers them one panel at a time to smoothing table 22. A vision system 24 located above smoothing table 22 is connected to a controller 26 to orient smoothing table 22 whereby panel loader assembly 30 can pick up the oriented fabric panel and move it for a subsequent operation.

Unloader assembly 20 includes a linear slide frame 32 for moving a plurality of pick-up heads 34 into an operable position with the top of the stack 16 of fabric pieces and to grasp an individual panel of fabric and remove it from stack 16. Drive means 36 connected to slide frame 32 moves the plurality of pick-up heads 34 in the x and z directions up and away from the upper surface of the stack 16 of fabric pieces and over and down onto the upper surface of smoothing table 22.

Smoothing table 22 includes a platen 40 having a flat upper surface and forming a plenum. A drive assembly 42 is attached to the lower portion of platen 40 for moving the platen in the x, y and theta directions. A source of vacuum 44 is connected to the plenum chamber of platen 40 for causing the fabric panel to remain stationary on the upper surface of platen 40.

Panel loader assembly 30 includes a linear slide frame 46 for supporting a plurality of vacuum pick-up arms 50. Drive means 52 moves slide frame 46 in the x direction between a position above the surface of smoothing table 22 to a second position where the fabric panel is presented to a work station for subsequent operations.

Figure 2:
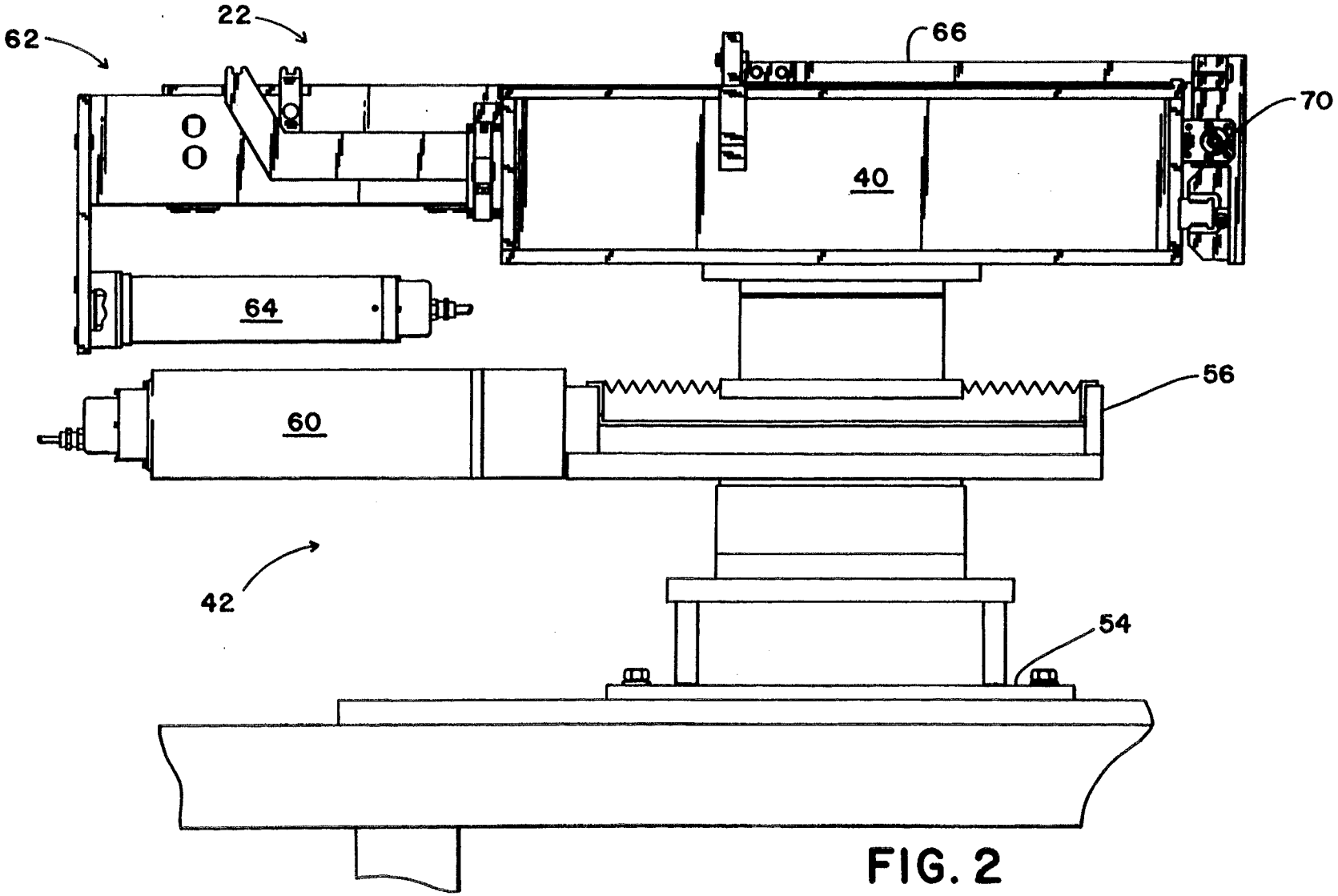
FIG. 2 is an enlarged side elevational view of the smoothing table shown in FIG. 1.

As best seen in FIG. 2, there is shown an enlarged side elevation view of the smoothing table 22. Smoothing table 22 includes a base 54 onto which an x-slide 56 and an x-drive means 60 are attached thereto. The upper surface of platen 40 includes an edge smoothing assembly 62. The edge smoothing assembly 62 generally includes a drive means 64 for moving a plurality of plates 66 on the surface of platen 40 by means of a lead-screw assembly 70. The movement of the plates outwardly from the center of the platen and parallel to the surface of the platen operates to remove wrinkles from the fabric panel.

Figure 3:
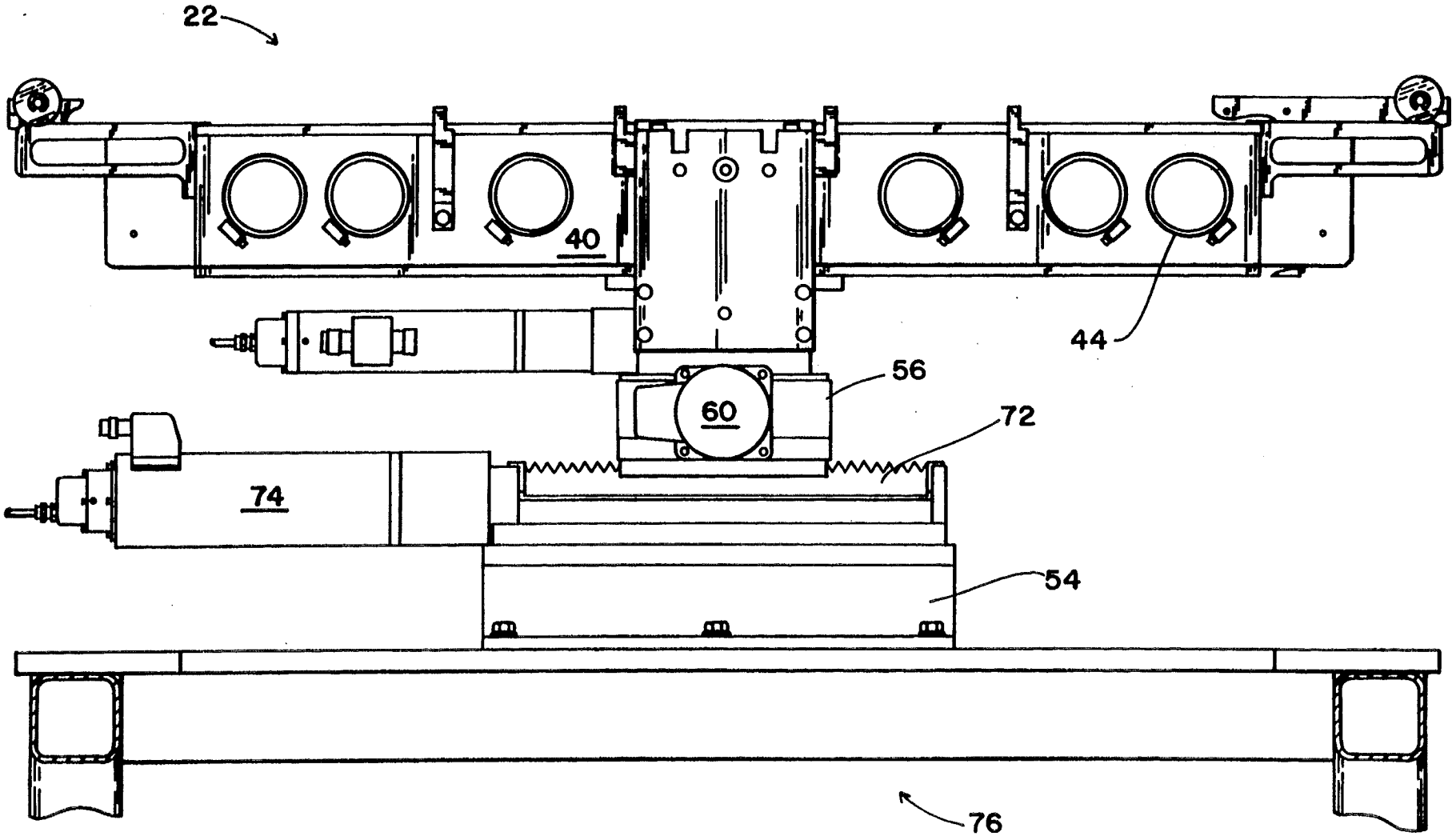
FIG. 3 is an enlarged front elevational view of the smoothing table shown in FIG. 1.

Turning now to FIG. 3, there is shown an enlarged front elevation view of the smoothing table 22. As can be seen, smoothing table 22 also includes a y-linear slide 72 and a y-drive means 74 from moving the table in the y direction. In combination with x slide 56 and x drive means 60 and theta drive means 76, the table can be oriented in three degrees of freedom by the operation of vision system 24 and controller 26.

Figure 4:
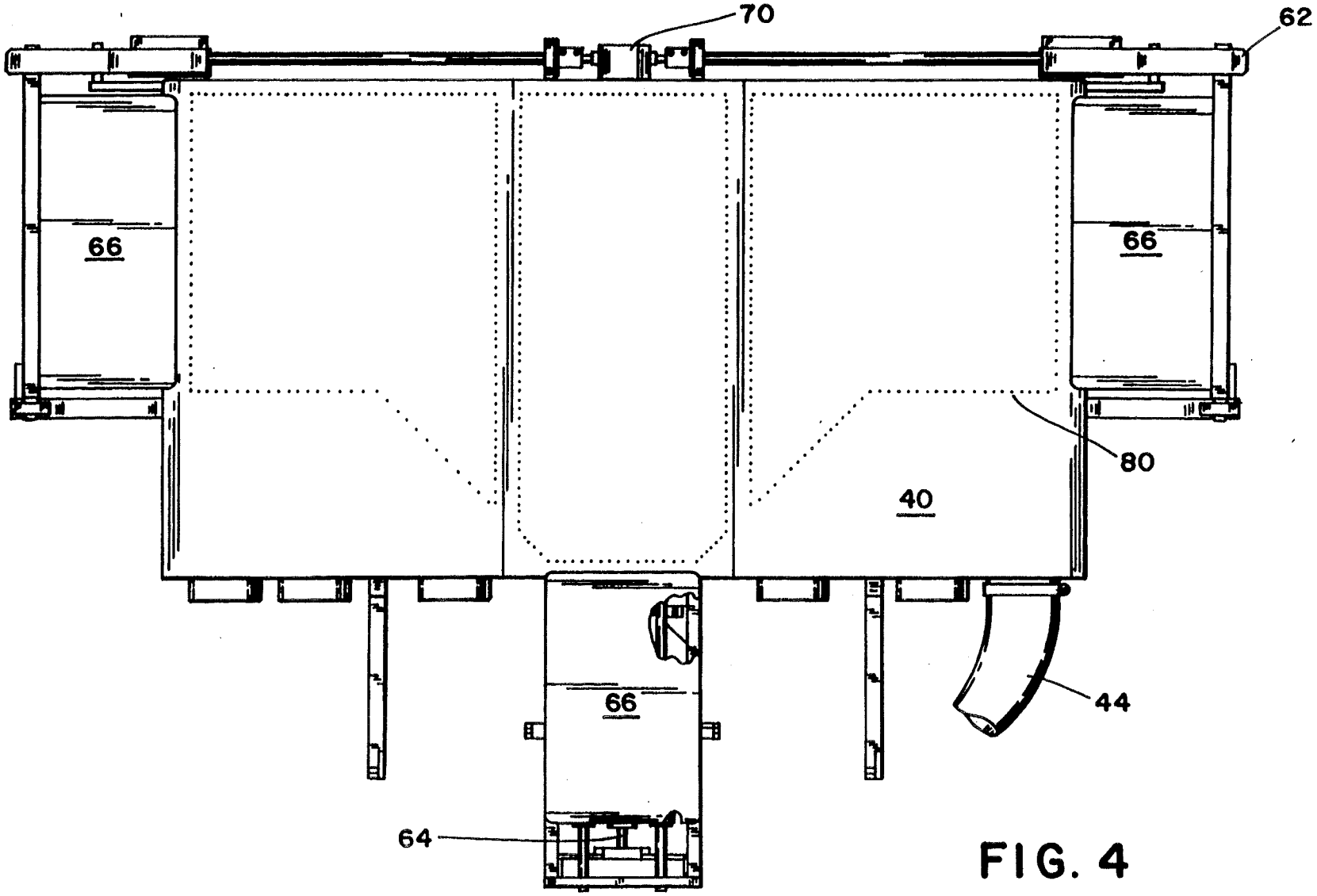
FIG. 4 is an enlarged top view of the smoothing table shown in FIG. 1.

As best seen in FIG. 4, there is shown an enlarged top view of the smoothing table 22. The upper surface of platen 40 includes a plurality of perforated apertures 80 whereby a source of vacuum 44 provides a stream of air through the perforated apertures adjacent to the upper surface and the fabric panel on the surface thereby causing the fabric panel to remain stationary on the surface of the platen. In their initial position, smoothing plates 66 extend over the surface of the platen until the fabric plan is transferred to the surface of the platen. At that point, drive 64 is actuated and smoothing plates 66 are moved outwardly by lead screw assembly 70 simultaneously thereby causing the surface of the fabric panel to be smoothed. After the fabric panel is smoothed onto the upper surface platen 40 and platen 40 is oriented by vision system 24 and controller 26 and drives 60, 74, and 76, panel loader assembly 30 moves into position to pick up the oriented fabric panel.

Figure 5:
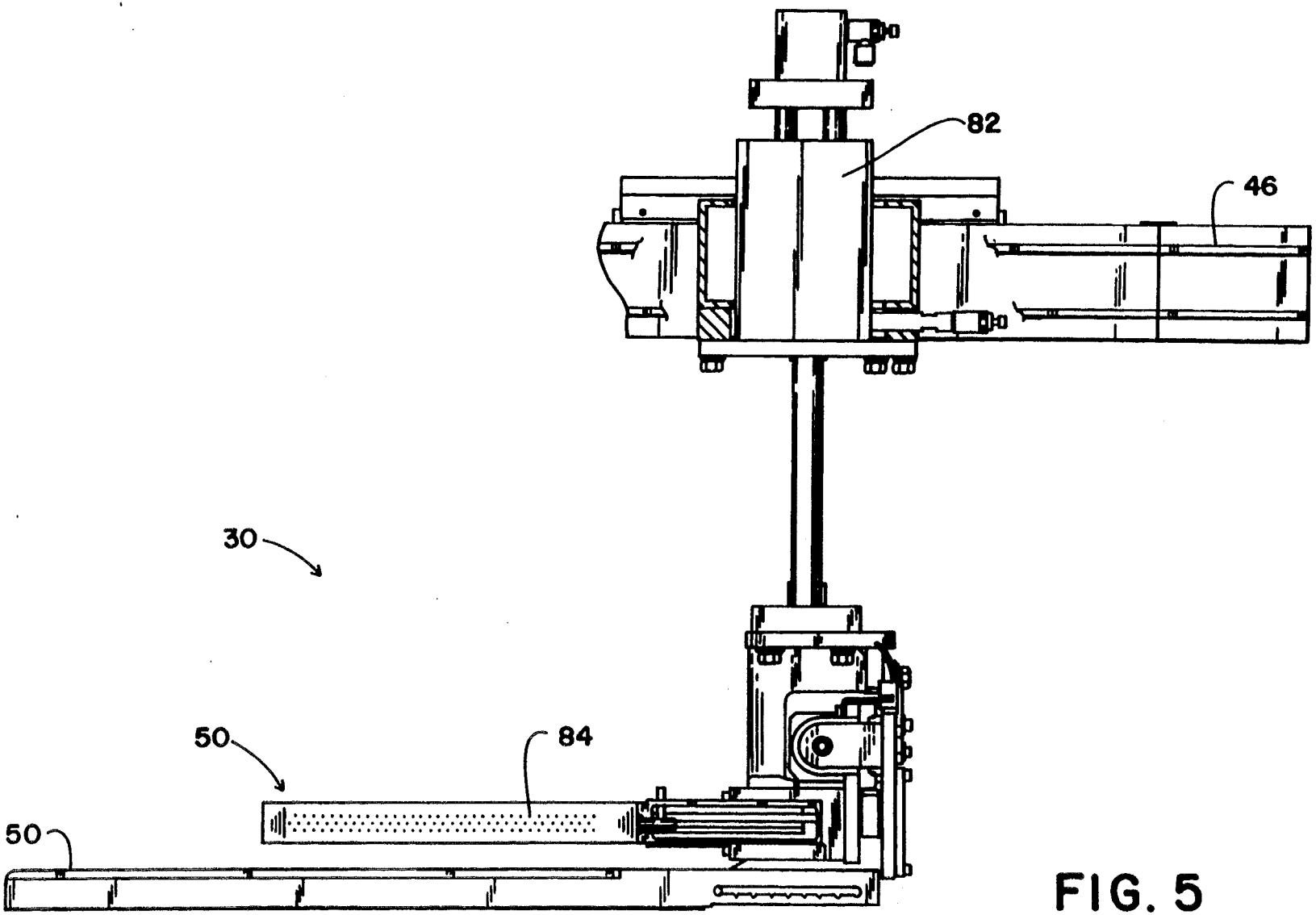
FIG. 5 is an enlarged side elevational view of the panel loader shown in FIG. 1.

As best seen in FIG. 5, there is shown an enlarged side elevational view of the panel loader shown in FIG. 1. In addition to the x-drive means 52, panel loader assembly 30 also includes a y-drive means 82 for moving the panel loader assembly with respect to the upper surface of platen 40 and the fabric panel thereon. Each of the plurality of vacuum pick-up arms 50 include perforated apertures 84 connected to a second source of vacuum 93 for removing the fabric panel from the upper surface of platen 40. While other types of pick-up devices can be used, a vacuum pick-up device ensures the most positive positioning of the fabric panel since the surface of the fabric panel is not distorted mechanically.

Figure 6:
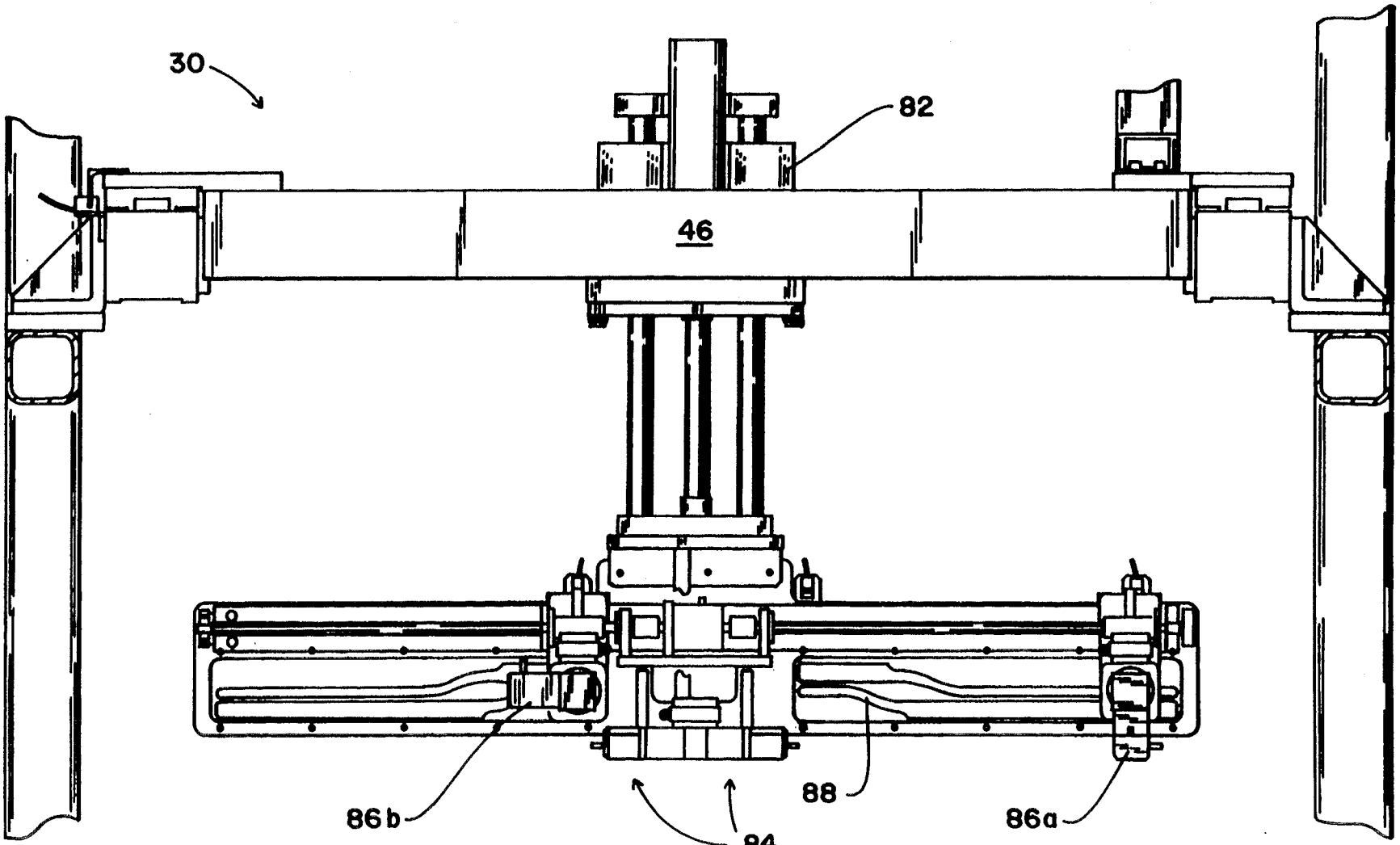
FIG. 6 is an enlarged front elevational view of the panel loader shown in FIG. 1.

Turning now to FIG. 6, there is shown an enlarged front elevational view of panel loader assembly 30. As can be seen, panel loader assembly 30 preferably includes two types of vacuum pick-up arms 50. A central stationary arms 84 pick up the central portion of the fabric panel. A pair of pivotable arms 86 move from a outward position **86*a* to an inward position rotated 90° with respect to the surface of the platen 86*b* by means of cam followers 88**. This arrangement allows the outer edges of the fabric panel to be oriented at 90° to the central portion of the fabric panel thereby permitting the fabric panel to be utilized in subsequent sewing operations.

Figure 7:
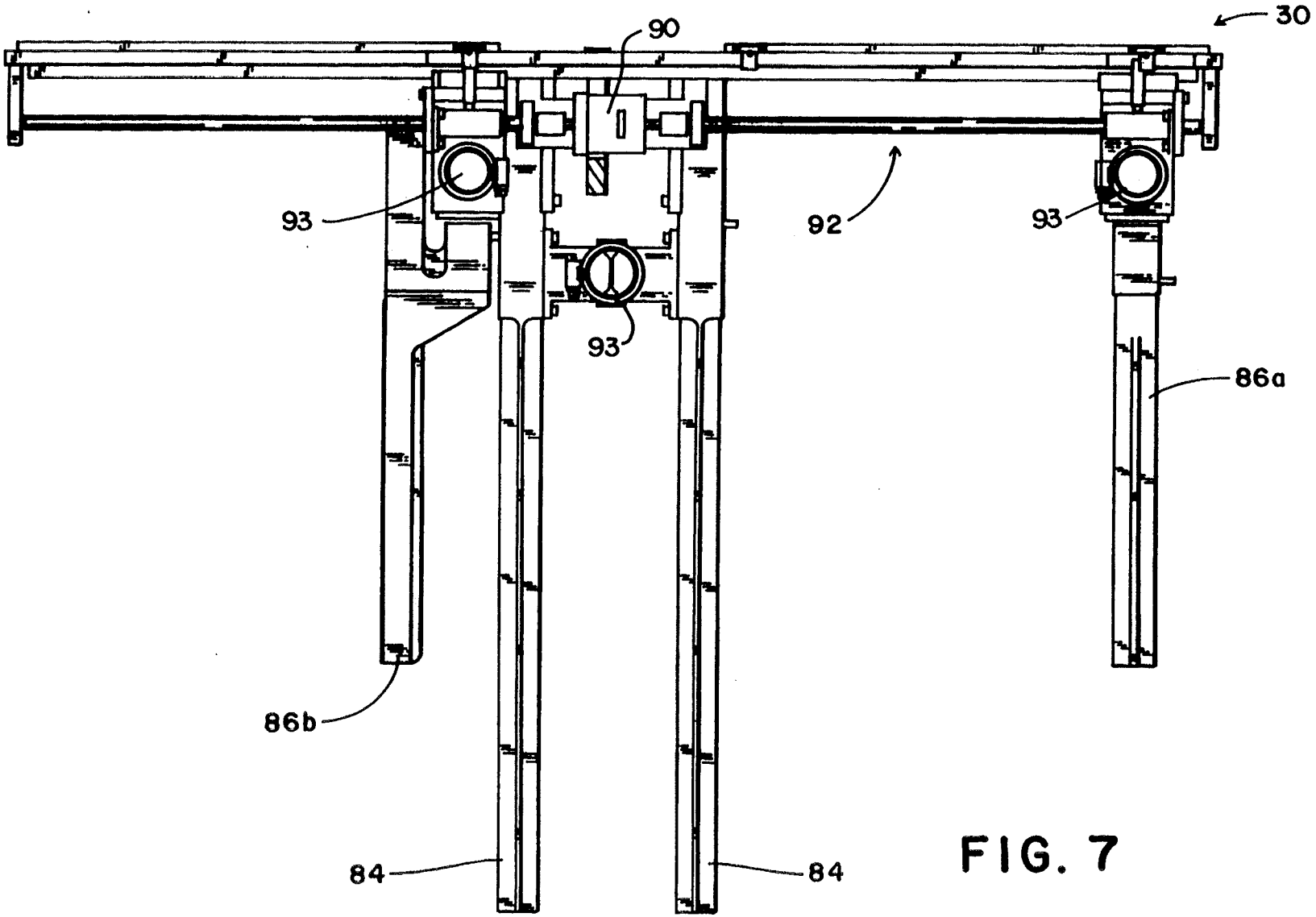
FIG. 7 is an enlarged top view of the panel loader shown in FIG. 1.

As best seen in FIG. 7, there is shown an enlarged top view of the panel loader assembly 30. As can be seen, drive 90 is connected to lead screws 92 for moving outward pivotable arms 86 along cam followers 88 to orient the arms between parallel and 90° orientation.

Figure 8:
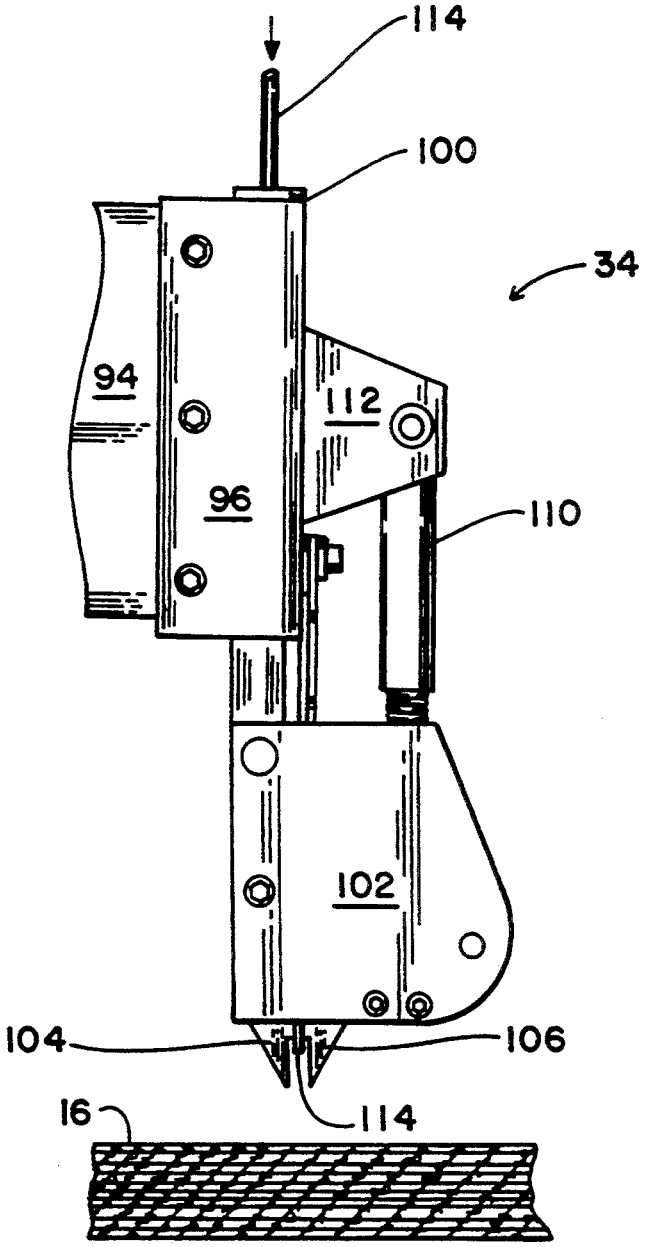
FIG. 8 is an enlarged side elevational view of a single unloader pick-up device.

Finally, turning to FIG. 8, there is shown an enlarged side elevation view of a single unloader pick-up device 34 used in unloader 20. In the preferred embodiment, fabric pick-up device 34 includes a mounting base 96 which is attached to support 94. A frame 100 is slidably mounted to the base 96 thereby allowing the pick-up device to adjust for variations in the height of the stack 16 of fabric pieces. A gripper head 102 is attached to one end of the frame 100.

Gripper head 102 includes a stationary jaw 104 and a moveable jaw 106. The jaws 104, 106 are actuated by a pneumatic cylinder 110 having one end attached to bracket 112 and the other end attached to a Jaw actuator. In the preferred embodiment, an air ejector tube 114 passes through frame 100 and has one end connected to a source of compressed air and the other end adjacent to jaws 104, 106.

In operation, the pick-up device is positioned adjacent to the top ply fabric piece and brought in contact with the surface of the fabric piece. The pickup device is then actuated to grasp the surface of the fabric piece and to lift it upwardly to separate it from the adjacent fabric piece. The pick-up device is then moved in a linear fashion to place the fabric piece onto the smoothing table where it can be smoothed and oriented for pick-up by panel loader assembly 30.

Certain modifications and improvements will occur to those skilled in the art upon a reading of the foregoing description. By way of example, the fabric magazine could be replaced with a die cut machine directly adjacent to the table for supplying the fabric pieces. Also, electrostatic means could be used to hold the fabric pieces in place instead of vacuum. It should be understood that all such modifications and improvements have been deleted herein for the sake of conciseness and readability but are properly within the scope of the following claims.

We claim:

1. An apparatus for automatically feeding a fabric panel from a stack of fabric pieces, orientating said fabric panel and transferring said fabric panel to a work station, said apparatus comprising:

(a) a table for receiving said fabric panel from said stack of fabric pieces, said table being operable to move said fabric panel into a predetermined orientation; and (b) a panel loader for removing said fabric panel from said table and transferring said panel to said work station, wherein said panel loader includes a support frame having a linear slide, at least one pickup assembly attached to said slide, and drive means for moving said pickup assembly along said slide between said table and said work station, wherein said pickup assembly includes at least one arm having a plenum and a perforated surface along a portion of said plenum and a source of vacuum connected to said plenum for selectively picking up said fabric panel from said table and further including at least one central horizontally oriented arm and a pair of arms offset from and parallel to said central arm, wherein said pair of arms offset from and parallel to said central arm are selectively movable between a first position in the same plane as said central arm to a second position in a plane perpendicular to said central arm.

2. The apparatus according to claim 1, further including a fabric pickup assembly for removing said fabric panel from said stack of fabric pieces and transferring said panel to said table.

3. An apparatus for automatically moving a fabric panel from a stack of fabric pieces to a predetermined orientation with respect to a panel loader, said apparatus comprising:

(a) a table for receiving said fabric panel from said stack of fabric pieces, wherein said table includes a plenum having a perforated surface, said plenum being connected to a source of vacuum for maintaining said fabric panel in a stationary position and further including an edge smoothing assembly whereby the edges of said fabric panel are smoothed prior to moving said table, wherein said edge smoothing assembly includes at least one plate movable between a first position between said perforated surface and said fabric panel and a second position parallel and away from said perforated surface and said fabric panel, whereby the movement of said plate causes said fabric panel to be smoothed;

(b) drive means attached to said table for moving said table with respect to said panel loader; and (c) a vision system connected to said drive means for controlling said drive means to move said table in response to a control signal indicating the position of said fabric panel with respect to said panel loader.

4. The apparatus according to claim 3, wherein said drive means is movable in the x, y and theta directions with respect to said panel loader.

5. The apparatus according to claim 3, wherein said vision system connected to said drive means for controlling said drive means to move said table in response to a control signal indicating the position of said fabric panel includes at least one camera and a control system connected between said camera and said drive means.

6. An apparatus for automatically feeding a fabric panel from a stack of fabric pieces, orientating said fabric panel and transferring said fabric panel to a work station, said apparatus comprising:

(a) a fabric pickup assembly for removing said fabric panel from said stack of fabric pieces and transferring said panel;

(b) a smoothing table for receiving said fabric panel and for automatically moving said fabric panel from said stack of fabric pieces: to a predetermined orientation, said smoothing table including: (i) a table for receiving said fabric panel from said stack of fabric pieces; (ii) drive means attached to said table for moving said table; and (iii) a vision system connected to said drive means for controlling said drive means to move said table in response to a control signal indicating the position of said fabric panel; and (c) a panel loader for removing said fabric panel from said table and transferring said panel to said work station, wherein said panel loader includes a support frame having a linear slide, at least one pickup assembly attached to said slide, and drive means for moving said pickup assembly along said slide between said table and said work station, wherein said pickup assembly includes at least one arm having a plenum and a perforated surface along a portion of said plenum and a source of vacuum connected to said plenum for selectively picking up said fabric panel from said table and further including at least one central horizontally oriented arm and a pair of arms offset from and parallel to said central arm, wherein said pair of arms offset from and parallel to said central arm are selectively movable between a first position in the same plane as said central arm to a second position in a plane perpendicular to said central arm.

7. The apparatus according to claim 6, wherein said drive means is movable in the x, y and theta directions with respect to said panel loader.

8. The apparatus according to claim 6, wherein said vision system connected to said drive means for controlling said drive means to move said table in response to a control signal indicating the position of said fabric panel includes at least one camera and a control system connected between said camera and said drive means.

9. An apparatus for automatically feeding a fabric panel from a stack of fabric pieces, orientating said fabric panel and transferring said fabric panel to a work station, said apparatus comprising:

(a) a fabric pickup assembly for removing said fabric panel from said stack of fabric pieces and transferring said panel;

(b) a smoothing table for receiving said fabric panel and for automatically moving said fabric panel from said stack of fabric pieces to a predetermined orientation, said smoothing table including: (i) a table for receiving said fabric panel from said stack of fabric pieces, wherein said table includes a plenum having a perforated surface, said plenum being connected to a source of vacuum for maintaining said fabric panel in a stationary position and further including an edge smoothing assembly whereby the edges of said fabric panel are smoothed prior to moving said table, wherein said edge smoothing assembly includes at least one plate movable between a first position between said perforated surface and said fabric panel and a second position parallel and away from said perforated surface and said fabric panel, whereby the movement of said plate causes said fabric panel to be smoothed; (ii) drive means attached to said table for moving said table; and (iii) a vision system connected to said drive means for controlling said drive means to move said table in response to a control signal indicating the position of said fabric panel; and (c) a panel loader for removing said fabric panel from said table and transferring said panel to said work station.

10. The apparatus according to claim 9, wherein said panel loader includes a support frame having a linear slide, at least one pickup assembly attached to said slide, and drive means for moving said pickup assembly along said slide between said table and said work station.

11. The apparatus according to claim 10, wherein said pickup assembly includes at least one arm having a plenum and a perforated surface along a portion of said plenum and a source of vacuum connected to said plenum for selectively picking up said fabric panel from said table.

12. The apparatus according to claim 11, further including at least one central horizontally oriented arm and a pair of arms offset from and parallel to said central arm.

13. The apparatus according to claim 12, wherein said pair of arms offset from and parallel to said central arm are selectively movable between a first position in the same plane as said central arm to a second position in a plane perpendicular to said central arm.

14. The apparatus according to claim 9, wherein said drive means is movable in the x, y and theta directions with respect to said panel loader.

15. The apparatus according to claim 9, wherein said vision system connected to said drive means for controlling said drive means to move said table in response to a control signal indicating the position of said fabric panel includes at least one camera and a control system connected between said camera and said drive means.

16. A method for automatically feeding a fabric panel from a stack of fabric pieces, orientating said fabric panel and transferring said fabric panel to a work station, said method comprising the steps of:

(a) receiving said fabric panel from said stack of fabric pieces onto a table, said table being operable to move said fabric panel into a predetermined orientation; and (b) removing said fabric panel from said table by a panel loader and transferring said panel to said work station, wherein said panel loader includes a support frame having a linear slide, at least one pickup assembly attached to said slide, and drive means for moving said pickup assembly along said slide between said table and said work station, wherein said pickup assembly includes at least one arm having a plenum and a perforated surface along a portion of said plenum and a source of vacuum connected to said plenum for selectively picking up said fabric panel from said table and further including at least one central horizontally oriented arm and a pair of arms offset from and parallel to said central arm, wherein said pair of arms offset from and parallel to said central arm are selectively movable between a first position in the same plane as said central arm to a second position in a plane perpendicular to said central arm.

17. A method for automatically moving a fabric panel from a stack of fabric pieces to a predetermined orientation with respect to a panel loader, said method comprising the steps of:

(a) receiving said fabric panel from said stack of fabric pieces onto a table, wherein said table includes a plenum having a perforated surface, said plenum being connected to a source of vacuum for maintaining said fabric panel in a stationary position and further including an edge smoothing assembly whereby the edges of said fabric panel are smoothed prior to moving said table, wherein said edge smoothing assembly includes at least one plate movable between a first position between said perforated surface and said fabric panel and a second position parallel and away from said perforated surface and said fabric panel, whereby the movement of said plate causes said fabric panel to be smoothed;

(b) moving said table with respect to said panel loader by a drive means; and (c) controlling said drive means by a vision system connected to said drive means to move said table in response a control signal indicating the position of said fabric panel with respect to said panel loader.

18. A method for automatically feeding a fabric panel from a stack of fabric pieces, orientating said fabric panel and transferring said fabric panel to a work station, said method comprising the steps of:

(a) removing said fabric panel from said stack of fabric pieces and transferring said panel;

(b) receiving said fabric panel onto a smoothing table and automatically moving said fabric panel from said stack of fabric pieces to a predetermined orientation, said smoothing table including: (i) a table for receiving said fabric panel from said stack of fabric pieces; (ii) drive means attached to said table for moving said table; and (iii) a vision system connected to said drive means for controlling said drive means to move said table in response to a control signal indicating the position of said fabric panel; and (c) removing said fabric panel from said table by a panel loader and transferring said panel to said work station, wherein said panel loader includes a support frame having a linear slide, at least one pickup assembly attached to said slide, and drive means for moving said pickup assembly along said slide between said table and said work station, wherein said pickup assembly includes at least one arm having a plenum and a perforated surface along a portion of said plenum and a source of vacuum connected to said plenum for selectively picking up said fabric panel from said table and further including at least one central horizontally oriented arm and a pair of arms offset from and parallel to said central arm, wherein said pair of arms offset from and parallel to said central arm are selectively movable between a first position in the same plane as said central arm to a second position in a plane perpendicular to said central arm.

19. A method for automatically feeding a fabric panel from a stack of fabric pieces, orientating said fabric panel and transferring said fabric panel to a work station, said method comprising the steps of:

(a) removing said fabric panel from said stack of fabric pieces and transferring said panel;

(b) receiving said fabric panel onto a smoothing table and automatically moving said fabric panel from said stack of fabric pieces to a predetermined orientation, said smoothing table including: (i) a table for receiving said fabric panel from said stack of fabric pieces, wherein said table includes a plenum having a perforated surface, said plenum being connected to a source of vacuum for maintaining said fabric panel in a stationary position and further including an edge smoothing assembly whereby the edges of said fabric panel are smoothed prior to moving said table, wherein said edge smoothing assembly includes at least one plate movable between a first position between said perforated surface and said fabric panel and a second position parallel and away from said perforated surface and said fabric panel, whereby the movement of said plate causes said fabric panel to be smoothed; (ii) drive means attached to said table for moving said table; and (iii) a vision system connected to said drive means for controlling said drive means to move said table in response to a control signal indicating the position of said fabric panel; and (c) removing said fabric panel from said table and transferring said panel to said work station.

* * * * *